US008310157B2

(12) United States Patent
Kuenzler et al.

(10) Patent No.: US 8,310,157 B2
(45) Date of Patent: Nov. 13, 2012

(54) LAMP HAVING METAL CONDUCTOR BONDED TO CERAMIC LEG MEMBER

(75) Inventors: Glenn Howard Kuenzler, Beachwood, OH (US); Deeder Aurongzeb, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 466 days.

(21) Appl. No.: 12/207,942

(22) Filed: Sep. 10, 2008

(65) Prior Publication Data

US 2010/0060164 A1 Mar. 11, 2010

(51) Int. Cl.
*H01J 61/36* (2006.01)

(52) U.S. Cl. ..... 313/623; 313/633

(58) Field of Classification Search ..... 313/623–625, 313/633

See application file for complete search history.

(56) References Cited

U.S. PATENT DOCUMENTS

| | | | | |
|---|---|---|---|---|
| 3,852,086 | A * | 12/1974 | Murata et al. | 148/22 |
| 4,761,349 | A | 8/1988 | McPheeters et al. | |
| 4,983,889 | A * | 1/1991 | Roberts | 315/246 |
| 5,001,396 | A * | 3/1991 | Snellgrove et al. | 313/625 |
| 5,404,078 | A * | 4/1995 | Bunk et al. | 313/625 |
| 5,426,343 | A * | 6/1995 | Rhodes et al. | 313/623 |
| 5,512,155 | A * | 4/1996 | Fukasawa | 204/298.11 |
| 5,637,960 | A | 6/1997 | Juengst et al. | |
| 5,695,530 | A | 12/1997 | Hong et al. | |
| 5,725,827 | A | 3/1998 | Rhodes et al. | |
| 5,742,123 | A * | 4/1998 | Nagayama | 313/623 |
| 5,955,832 | A | 9/1999 | Tomita et al. | |
| 6,126,887 | A | 10/2000 | Ward et al. | |
| 6,346,495 | B1 | 2/2002 | Dynys et al. | |
| 6,414,451 | B1 | 7/2002 | Baake et al. | |
| 6,589,405 | B2 | 7/2003 | Weres et al. | |
| 6,731,068 | B2 | 5/2004 | Dakin et al. | |
| 6,835,488 | B2 | 12/2004 | Sasahara et al. | |
| 7,063,586 | B2 | 6/2006 | Scott et al. | |
| 7,144,651 | B2 | 12/2006 | Finn et al. | |
| 7,382,097 | B2 | 6/2008 | Seredich et al. | |
| 2003/0230363 | A1 | 12/2003 | Sturgill et al. | |
| 2004/0036415 | A1 * | 2/2004 | Kai et al. | 313/626 |
| 2004/0119414 | A1 * | 6/2004 | Bewlay et al. | 313/636 |
| 2005/0253521 | A1 * | 11/2005 | Scholl et al. | 313/626 |

(Continued)

FOREIGN PATENT DOCUMENTS

EP 0 204 303 10/1986

(Continued)

OTHER PUBLICATIONS

Definition of granulated, retried from oxford english dictionary online Jul. 18, 2011.*

*Primary Examiner* — Nimeshkumar Patel
*Assistant Examiner* — Steven Horikoshi
(74) *Attorney, Agent, or Firm* — Fay Sharpe LLP

(57) ABSTRACT

A lamp includes a discharge vessel comprising a body portion defining a discharge space and leg members extending therefrom. Electrode assemblies include conductors carried by bores of the respective leg members. At least one of the conductors is bonded directly to the respective leg member within the bore, without the need for a sealing material, to form an airtight seal. Electrodes are electrically connected to the conductors and extend into the discharge vessel. An ionizable fill is sealed within the vessel.

23 Claims, 8 Drawing Sheets

U.S. PATENT DOCUMENTS

| | | | | |
|---|---|---|---|---|
| 2006/0022595 | A1* | 2/2006 | Bewlay et al. | 313/623 |
| 2006/0220558 | A1 | 10/2006 | Watanabe et al. | |
| 2007/0138961 | A1* | 6/2007 | Bewlay et al. | 313/623 |
| 2009/0212704 | A1* | 8/2009 | Wei et al. | 313/623 |
| 2010/0027244 | A1* | 2/2010 | Wada et al. | 362/97.1 |

FOREIGN PATENT DOCUMENTS

| | | | |
|---|---|---|---|
| EP | 1 416 554 | | 6/2004 |
| WO | WO 87/05006 | A1 | 8/1987 |
| WO | WO 2006/044593 | A2 | 4/2006 |
| WO | WO 2008/075273 | A1 | 6/2008 |

* cited by examiner

LAMP HAVING METAL CONDUCTOR BONDED TO CERAMIC LEG MEMBER

BACKGROUND OF THE INVENTION

The present invention relates generally to ceramic to metal bonding and finds particular application in a ceramic arc discharge lamp.

Ceramic metal halide (CMH) lamps include a ceramic discharge vessel or "arc tube," which is typically formed from polycrystalline alumina with small amounts of other additives. An arc discharge is generated by ionizing a fill material, such as a mixture of metal halide and mercury in an inert gas, such as argon, with an arc passing between two electrodes. In general, CMH lamps are operated on an AC voltage supply source with a frequency of 50 or 60 Hz, if operated on an electromagnetic ballast, or higher if operated on an electronic ballast. The discharge is extinguished, and subsequently re-ignited in the lamp, upon each polarity change in the supply voltage. The electrodes and the fill material are sealed within a translucent or transparent discharge chamber, which maintains the pressure of the energized fill material and allows the emitted light to pass through. The fill material, also known as a "dose," emits a desired spectral energy distribution in response to being vaporized and excited by the electric arc. The electrodes are connected with a source of power by electrical conductors carried through tubular leg members of the discharge vessel. The conductors are typically formed from niobium, which has a similar coefficient of expansion to the ceramic used in forming the discharge vessel, and are hermetically sealed to the leg members with a seal glass, such as a dysprosia-alumina-silica glass.

The use of a seal glass to bond niobium to alumina places several design and processing constraints on the lamp. First, the seal glass has a maximum workable operating temperature of about 750° C. Additionally it is susceptible to corrosion by the rare earth elements in the fill. To minimize damage to the seals, they are positioned well away from the hottest part of the lamp, where the arc discharge forms. This governs the length of the legs, which must be long enough to sufficiently space the seals from the arc. This design results in a dead space in the legs of the discharge vessel which does not contribute to the light output yet which needs to be filled with the expensive halide dose. The length of the legs limits the ability for miniaturization and also renders the discharge vessel more prone to breakage in shipping. Additionally, the composition of the seal glass must be chosen carefully to match the thermal expansion characteristics of the conductors and ceramic, otherwise, the legs can crack during operation of the lamp. The seal glass position must be precisely controlled to minimize overlap with the molybdenum which is used to connect the tungsten electrode tips with the niobium conductors in order to avoid thermal expansion stresses. Finally, controlling arc gap requires crimping combined with careful time/temperature/pressure control in the drybox process to set desired electrode position.

The exemplary embodiment provides a discharge vessel and a method of forming a seal between alumina and metal which avoids the need to utilize a seal material.

BRIEF DESCRIPTION OF THE INVENTION

In accordance with one aspect of the exemplary embodiment, a lamp includes a ceramic discharge vessel comprising a body portion defining a discharge space and leg members extending therefrom. The lamp includes electrode assemblies that include conductors carried by bores of the leg members.

At least one of the conductors is bonded directly to the respective leg member within the bore to form an airtight seal. The conductor includes at least one of the group consisting of Nb, Ta, Re, and Os. Electrodes are electrically connected to the conductors and extend into the discharge vessel. An ionizable fill is sealed within the vessel.

In another aspect, a method of forming a hermetic seal between a conductor and a tubular ceramic body includes providing a conductive core with at least one of an oxidation-resistant layer and a corrosion-resistant layer to form a conductor, positioning the conductor within a bore of the tubular ceramic body, the bore having a diameter greater than a diameter of the conductor, and sintering the ceramic body to shrink the ceramic body onto the conductor to form a hermetic seal therebetween.

In another aspect, a method of forming a lamp includes forming an electrode assembly comprising an electrode and a conductor. The method further includes inserting the conductor into the bore of a ceramic body and sintering the ceramic body to shrink the ceramic body and bond the conductor to the ceramic body around the bore. The electrode assembly with the bonded conductor and sintered ceramic body are incorporated into a lamp such that the electrode protrudes from the sintered ceramic body into an interior discharge space.

DETAILED DESCRIPTION OF THE INVENTION

Aspects of the exemplary embodiment relate to a method for forming a bond between an electrically conductive member and a polycrystalline ceramic tubular body and to a bonded combination thereof. In the exemplary embodiment, the electrically conductive member is a conductor for a ceramic metal halide lamp and the ceramic body is a leg member of a discharge vessel. However, it is to be appreciated that the method finds application in other cases where an electrically conductive member is to be bonded to a ceramic body.

Figure 1:
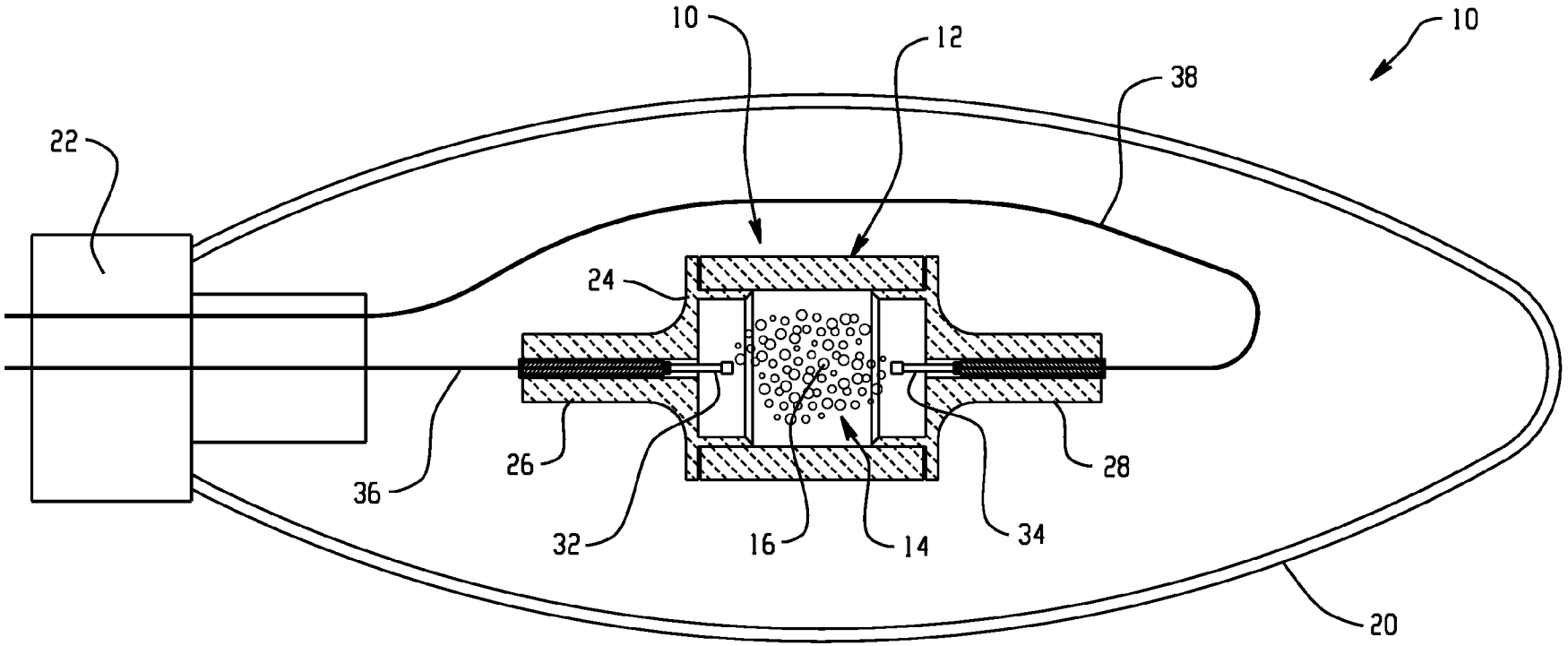
FIG. 1 is a cross sectional view of a lamp assembly incorporating a lamp in accordance with the exemplary embodiment.

With reference to FIG. 1, an exemplary lamp assembly 1 is shown. The lamp assembly includes a ceramic metal halide (CMH) discharge lamp 10 in accordance with the exemplary embodiment. The lamp 10 is supplied with current by a circuit (not shown) connected with a source of AC power. The lamp may be designed to run on an electronic ballast. Alternatively, the lamp may be run on a DC power source.

The lamp 10 includes a discharge vessel 12 in the form of a high pressure envelope or arctube, formed from a transparent or translucent ceramic material, such as polycrystalline alumina or sapphire (single crystal alumina), which is sealed at opposite ends to enclose a chamber or discharge space 14. The discharge space 14 contains a fill of an ionizable gas mixture 16. The discharge vessel may be enclosed in an outer envelope 20 of glass or other suitable transparent or translucent material, which is closed by a lamp cap 22 at one end.

In the exemplary embodiment, the fill includes a metal halide and insert gas mixture which may also include mercury. The metal halides may include one or more halides of rare earth elements, such as bromides and/or iodides of one or more lanthanides, such as Ce. Pr, Nd, Ho, or Dy. The inert gas may be xenon or argon.

The discharge vessel includes a central body portion 24 and first and second tubular leg members 26, 28, which extend from opposite ends of the body portion. First and second electrodes 32, 34, which may be predominantly formed from tungsten, extend into the discharge space 14. The word "predominantly," as used herein, implies the named constituent is at least a majority by weight (i.e., over 50%), and up to 100% by weight of whatever it constitutes. In the present case, this implies that tungsten constitutes the majority of the electrode, by weight. A discharge forms in the fill 16 between the electrodes 32, 34 when a voltage is applied across the electrodes. The electrodes 32, 34 are electrically connected to conducting wires 36, 38, which connect the electrodes to the external power supply (via the cap 22).

Figure 2:
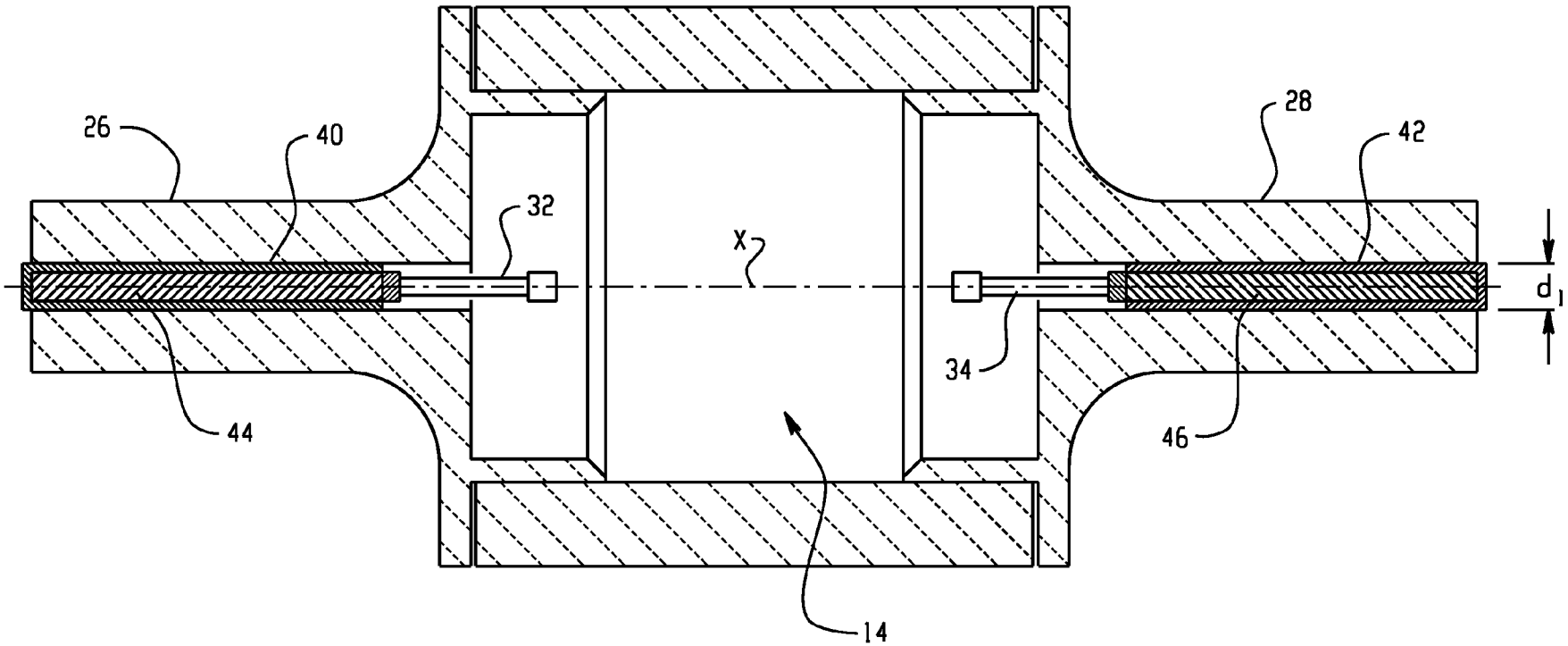
FIG. 2 is an enlarged cross sectional view of the discharge vessel of the lamp of FIG. 1.

As illustrated in FIG. 2, each leg member 26, 28 defines an axially extending bore 40, 42 having an internal diameter $d_1$. The bore 40, 42 carries an electrical conductor 44, 46 therethrough that connects the respective electrode 32, 34 with the conducting wire 36, 38.

Figure 3:
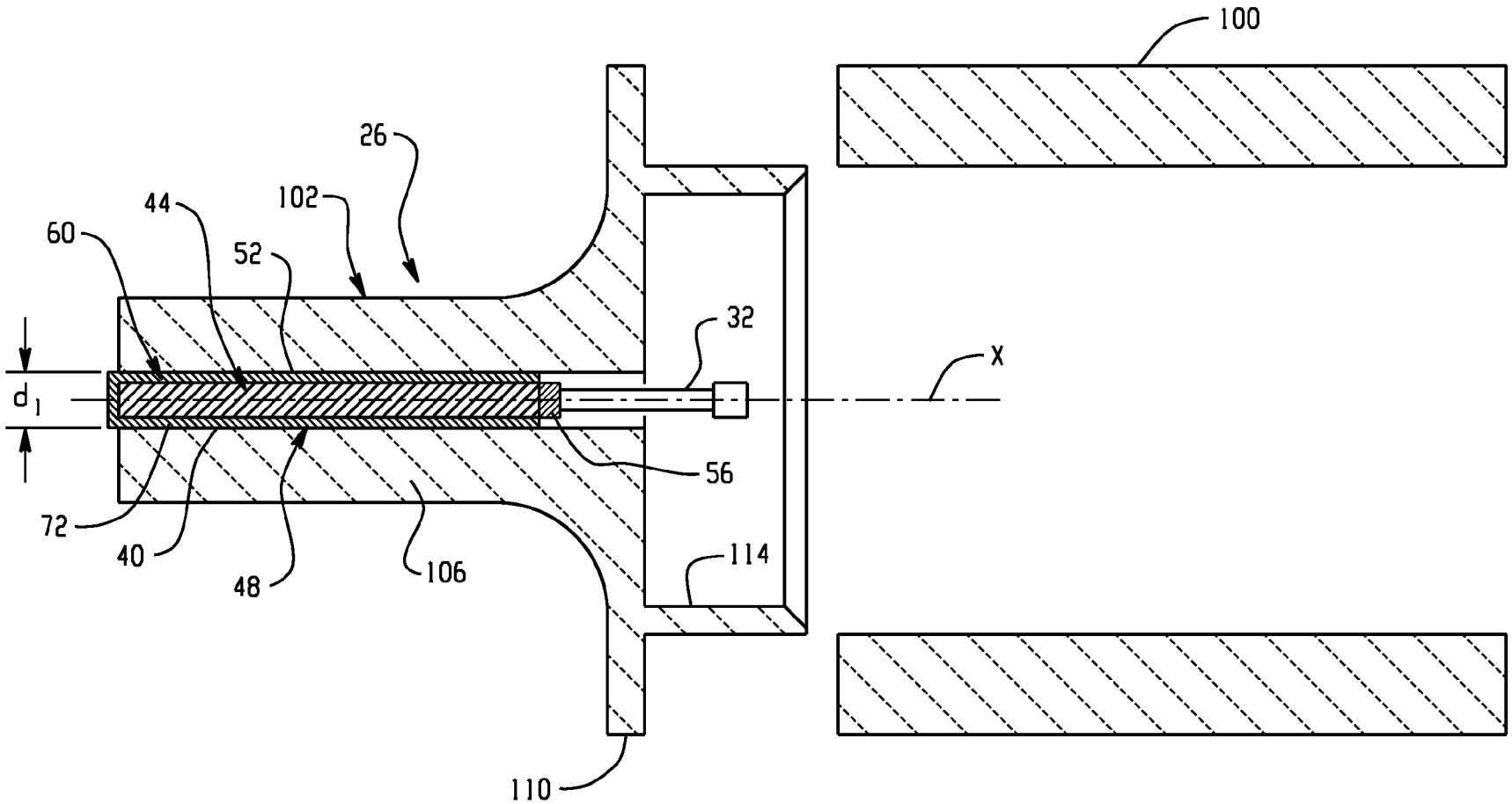
FIG. 3 is an enlarged exploded cross-sectional view of the discharge vessel of FIG. 2.

With reference also to FIG. 3, where only a portion of an exploded view of the discharge vessel is shown, with the understanding that the opposite side may be similarly configured, each conductor 44 includes an axially extending bonding portion 48, which is bonded to the respective leg member 26. Specifically, the bonding portion 48 has a diameter $d_1$ and an outer surface 52 which is in direct contact with the ceramic of the leg member 26 over a predominant portion of the respective bore 40. The bonding portion 48 is hermetically sealed to the respective leg member 26 by shrinkage of the leg member onto the bonding portion, as further described below, to provide an airtight seal which retains the fill gas in the discharge space without the need for any sealing material intermediate the surface 52 and the ceramic material defining the bore 40. Prior to sintering, the bore may have a diameter which is at least 10 μm larger than that of the conductor.

As a result, the leg member 26, 28 is not required to be of as long a length as in a conventional CMH lamp as there is no sealing glass which needs to be kept cool. The leg member need only be long enough to provide an adequate bonded length of the boding portion. The bonding portion may extend beyond the end of the leg member to allow for connection with the conducting wire 36, 38. For example, the leg member 26, 28 may extend from the body by a length L of about 3 cm or less, e.g., at least about 1 cm and in one embodiment, about 2 cm. In one embodiment, the length L of the leg is greater than the thickness of the arc tube wall.

Together, the conductor 44 and respective electrode 32 form an electrode assembly. Since both electrode assemblies of the lamp may be similarly configured, in the following description, only one electrode assembly will be described.

With reference to FIGS. 4-7, which show various embodiments of the electrode assembly, the conductor 44 may further include a molybdenum portion 56, such as a piece of wire, intermediate the tungsten electrode 32 and bonding portion 48, for ease of welding the tungsten of the electrode to the bonding portion during fabrication. Each bonding portion 48 includes a core 60 formed of niobium or other electrically conductive metal having a coefficient of expansion comparable with that of the ceramic of the leg member 26. Exemplary materials for forming the core include Nb, Ta, Re, Os, and Mo, and mixtures thereof where any of the elements may be present in the core at a concentration of at least 2% by weight. However, when the ceramic is predominantly formed from alumina (i.e., >50% alumina), the material or mixture of materials is beneficially selected such that the linear coefficient of thermal expansion a of the core at 25° C. is from about $5.0\times10^{-6}$–$7.4\times10^{-6}$/degree K at 25° C. and the thermal conductivity λ is from 0.4-1.1 W/cm/K at 27° C., and in one embodiment, is <0.9 W/cm/K at 27° C. Thus, for example, where Mo is used in forming the core ($\alpha=4.85\times10^{-6}$/degree K, $\lambda=1.38$), it is suitably combined with another metal such as niobium ($\alpha=7.3\times10^{-6}$/degree K, $\lambda=0.537$) which allows the optimal properties to be achieved.

For example, the core 60 may be at least about 20%, and in one embodiment, predominantly, or at least about 80% by weight niobium and in some embodiments, at least 95% by weight niobium. While some molybdenum may be present in the core 60, it is generally present at less than about 20%, since molybdenum does not have thermal expansion characterstics compatible with alumina-based ceramics. For examples the core may be formed of a molybdenum niobium mix where niobium is ≧90%. In the exemplary embodiment, the core is formed of a cylindrical rod with a circular cross section, the rod having an axial length, parallel with the lamp axis X-X, which is substantially greater than its diameter. However, elongate shapes with cross sections other than circular are also contemplated, such as a rod or tube with a square, rectangular, or oval cross section. The molybdenum wire 56 spaces the core 60 from the tungsten electrode 32 to provide a good weld joint and reduce contact of corrosive rare earth elements with the core. The diameter (or maximum cross section) of the core 60 may be from about 0.3 to 2 mm, depending on the wattage of the lamp, e.g., about 1 mm or less. For example the diameter may be about 700-800 μm.

Figure 4:
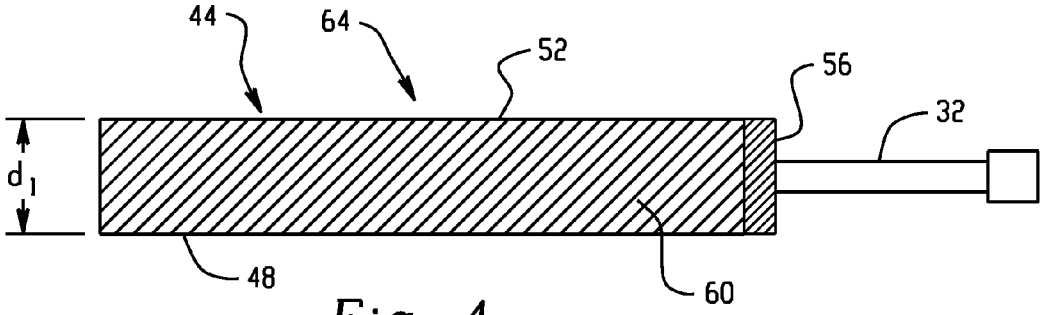
FIG. 4 is a side sectional view of a first embodiment of an electrode assembly which may be used in the discharge vessel of FIG. 3.
Figure 5:
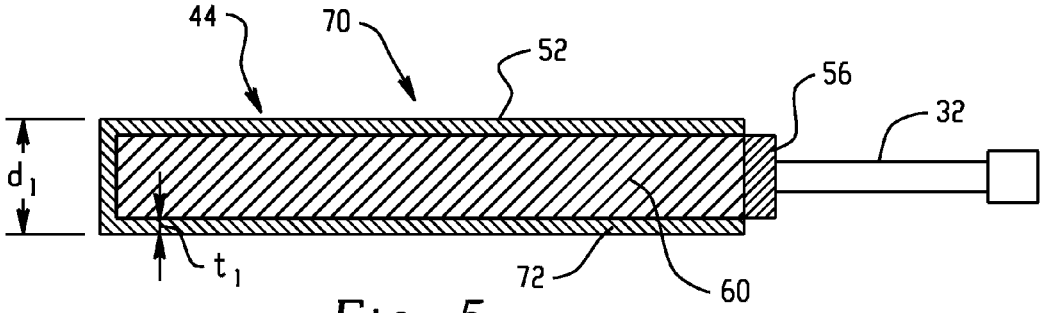
FIG. 5 is a side sectional view of a second embodiment of an electrode assembly which may be used in the discharge vessel of FIG. 3.
Figure 6:
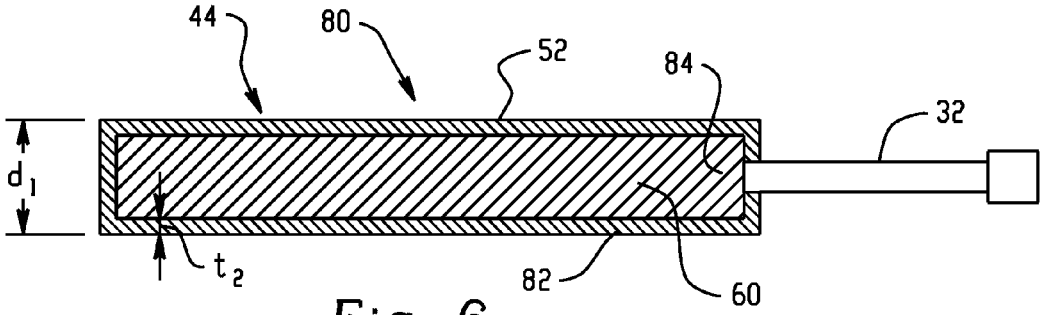
FIG. 6 is a side sectional view of a third embodiment of an electrode assembly which may be used in the discharge vessel of FIG. 3.
Figure 7:
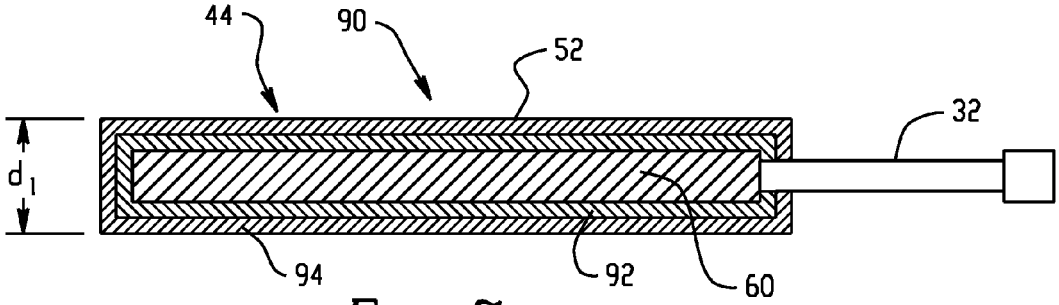
FIG. 7 is a side sectional view of a fourth embodiment of an electrode assembly which may be used in the discharge vessel of FIG. 3.

In one embodiment, the core 60 is bonded directly to the ceramic. An electrode assembly 64 in accordance with this embodiment may be configured as shown in FIG. 4. In this embodiment, the core 60 defines the outer surface 52 of the connector. In another embodiment, the conductor core can be partially oxidized to form an oxide scale of about 1 μm or less in thickness, but no greater than about half the thickness of the metal core.

In another embodiment of an electrode assembly 70 (FIG. 5), the core 60 is spaced from the bore by an intermediate barrier layer 72. The barrier layer 72 is an oxidation-resistant layer which protects the underlying core 60 from oxidation during removal of binder from a ceramic body in which the electrode assembly is mounted, as will be described in greater detail below. In particular, the barrier layer 72 blocks attack of the core by oxygen in an oxygen containing environment, such as air, when the electrode assembly is heated at a temperature of about 900° C. for 24 hours. The barrier layer 72 may decompose/evaporate at the higher temperatures (e.g., 1800° C.) used for sintering the ceramic body, but since this is achieved in an oxygen-free enviroument, the core is not damaged. The oxidation resistant barrier layer 72 may be formed from a refractory oxide, such as an oxide of one or more of Hf, Ni, Ta, Yb, Y, or other which has a melting point in excess of about 1200° C., e.g., >2000° C. For example, the oxidation resistant barrier layer 72 is at least 20% by weight of refractory oxides having a melting point in excess of 1200° C. In another embodiment, layer 12 is predominantly formed from refractor oxide(s). Alternatively, an oxidation resistant meta, such as gold, may be used as the barrier layer 72. The layer 72 may have a thickness which exceeds the grain size of the core surface to ensure complete coverage of the core. The thickness $t_1$ of the barrier layer may be from 1 μm to about 50 μm, and generally from about 2 μm to about 10 μm, e.g., less than 5 μm. In this embodiment the barrier layer 72 defines the outer surface 52 of the connector. The barrier layer 72 may completely surround the core, as shown. In another embodiment, the barrier layer 72 is in contiguous contact with the core over at least 50% of its surface. It may be noted that the refractory oxides do not offer significant protection against corrosion by the rare earth elements in the fill.

In another embodiment of an electrode assembly 80 (FIG. 6), the core 60 is covered by a barrier layer 82. The barrier layer 82 is a corrosion-resistant layer which protects the underlying core 60 from corrosion by the gaseous fill (in particular, the rare earth halides of the fill and alkali metal salts, such as sodium salts) during the operation of the lamp. The corrosion-resistant barrier layer 82 may be formed from molybdenum or a carbide, such as WC, TaC, YC, ZrC, combination thereof, or the like. Other corrosion resistant materials such as Ta, Zr, Lu, Re, Os, and W metals, or combinations thereof may be employed. For example, the corrosion-resistant barrier layer 82 comprises at least 20% by weight of Mo, WC, TaC, YC, ZrC, Ta, Zr, Lu, Re, Os, W, or combination thereof, and may be at least 50% or at least 80% thereof. The thickness of the layer 82 is sufficient to resist attack of the core for the lifetime of the lamp. The thickness of the barrier layer 82 should not be so thick that it causes the ceramic to crack (if its thermal expansion characteristics differ from alumina, for example, the thickness $t_2$ may be from about 1 μm to about 20% of the thickness of the core. In this embodiment the barrier layer 82 may space the core from the bore so as to define the outer surface 52 of the connector, as shown. The barrier layer 82 may completely surround the core 60, as shown. In another embodiment, the barrier layer may only partially surround the core, specifically, those portions of the core which would otherwise be exposed to the gaseous fill during lamp operation, such as an inner end 84 of the core. In this latter embodiment, the barrier layer 82 need not space the core from the bore. In this embodiment, it is not necessary to provide a molybdenum spacer 56.

In another embodiment of an electrode assembly 90 (FIG. 7), the electrode assembly includes both a corrosion-resistant barrier layer 92, which may be analogously formed to barrier layer 72, and an oxidation-resistant barrier layer 94, which is formed as for barrier layer 82. In this embodiment the corrosion-resistant barrier layer 92 may space the oxidation-resistant barrier layer 94 from the core. Thus, layer 94 forms an outer layer of the boding portion and may define the outer surface 52 of the conductor. In this embodiment, the thicknesses of the two barrier layers 92, 94 layers may be as for the corresponding layers 72, 82, bearing in mind that the overall diameter of the conductor is $d_1$ in all embodiments.

In each of the embodiments of FIGS. 4-7, while the various barrier layers 72, 82, 92, 94 are shown only on the conductor, one or both of the barrier layers may extend over the electrode 32. The barrier layer(s), if present on the tungsten electrode tip, may burn off during operation of the lamp. In one embodiment, the oxidation-resistant layer 72, 94 provides a source of oxygen for the fill which functions in a regenerative cycle for transferring tungsten deposits on the wall of the lamp back to the electrodes.

A method of forming the lamp will now be described.

The electrode assembly 64, 70, 80, 90 may be formed as a unit and the conductor portion 44 inserted into the leg member 26 at any convenient stage during the formation of the discharge vessel, but which is prior to full shrinkage of the leg member such that a bond is formed between the conductor 44 and the leg member by shrinkage of the leg member. In general the conductor 44 is inserted into the ceramic body forming the leg member at a time when the bore would, thereafter, shrink by at least 5% in a direction perpendicular to the lamp axis in forming the sintered body if the conductor was not there. In some embodiments, the shrinkage is at least 10% in forming the sintered body. Because the conductor is positioned in the bore, the subsequent shrinkage of the bore diameter is somewhat less than predicted, thereby forming a strong bond.

The rod used for the core 60 may be surface treated to increase the surface granularity/roughness, which tends to improve boding with the leg member ceramic. The gram size of the core surface is increased in this step, to a grain size which is comparable to, or slightly less than that of the ceramic into which it is to be inserted. For example the rod is heated for about 3 hrs at a temperature of at least 1400° C., e.g., at about 1600° C. in an inert atmosphere, such as nitrogen, argon, or helium, or in a vacuum at <1 torr. The grain size of the ceramic may be, for example, 20±3μ.

To form the electrode assembly, the tungsten tip is welded to the optionally surface roughened conductor core, e.g., with laser welding, either directly, or via the molybdenum intermediate member, where present. Thereafter, the barrier layer or layers may be formed on the conductor core 60. The barrier layer(s) may be formed by any suitable coating technique, such as sputtering, chemical vapor deposition, or the like. For example, the oxidation resistant layer may be formed by electron beam sputtering of an oxide such as Hf, Ta, Yb, Ni, or Y oxide or a mixed oxide comprising one or more of these elements and/or Al. Exemplary oxides which may be deposited on the core include Hf+NiO, $HfAl_2O_4$, $TaYb_2O_3$, $TaY_2O_3$, and combinations thereof. Optionally, multiple layers of different oxides may be provided. For the corrosion resistant layer, carbides, such as TaC, Zr, or WC may be deposited, alone or in combination. In the case of the corrosion resistant layer, this may alternatively be formed by alloying one or more materials with an outer portion of the core to form a barrier layer in which niobium is present, but in an amount which is less, expressed as weight percent, than in the core. For example, Hf may be alloyed with an outer layer of the niobium core. In the case of an alloyed barrier layer 82, 94, the alloying may take place before welding of the tungsten electrode to the conductor.

Where two barrier layers are present, the corrosion-resistant layer is generally formed first, with the oxidation-resistant layer being deposited thereafter.

The ceramic discharge vessel may be formed by any suitable technique. For example, methods as described in U.S. Pat. Nos. 7,063,586, 7,382,097, 6,731,068, 6,346,495, and 6,126,887 may be used for forming the discharge vessel. The components are fabricated, for example, by die pressing, injection molding, or extruding a mixture of a ceramic powder and a binder system into a solid body. For die pressing, a mixture of about 95-98% of a ceramic powder and about 2-5% of a binder system is pressed into a solid body. For injection molding, larger quantities of binder are used, typically 40-55% by volume of binder and 60-45% by volume ceramic material.

Figure 8:
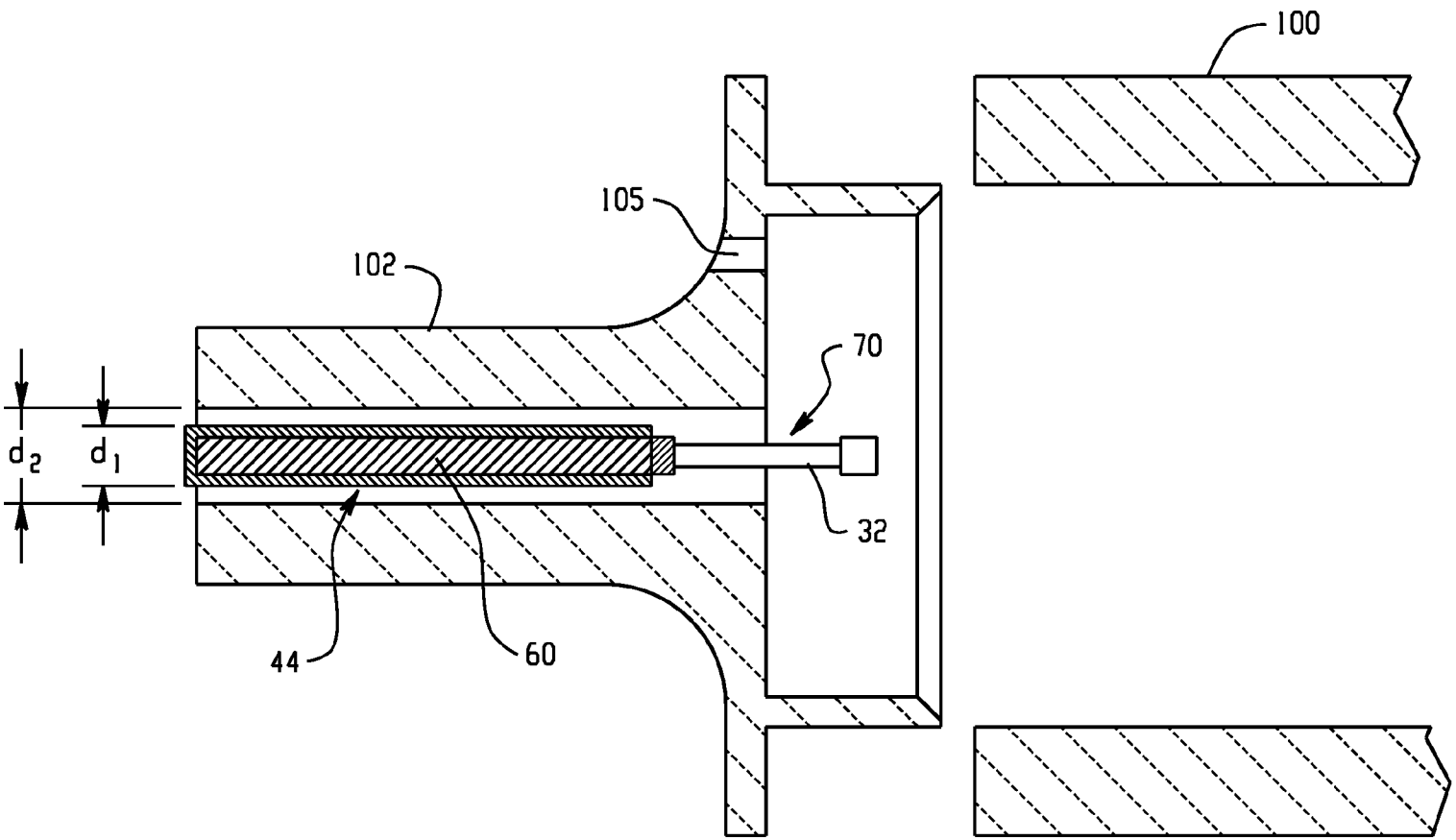
FIG. 8 illustrates an end plug with an electrode assembly therein prior to sintering of the end plug.

The ceramic discharge vessel may be formed from a single component or from multiple components. In one embodiment, the discharge vessel is assembled from separate components. As an example, the discharge vessel ma y be formed in a three part construction as illustrated in FIG. 8. In this embodiment a tubular barrel portion 100 and two end plugs 102, 104 are formed as separate components of green ceramic. The components are subsequently joined together during high temperature sintering in which the barrel portion shrinks slightly more than the end plugs to form a hermetic seal between the components. A fill port 105 is defined in one of the components 100, 102, 104, such as the end plug 102 (FIG. 8). This can be formed during molding of the green ceramic part or afterwards, e.g., by drilling. The fill port extends into the discharge space, allowing the sintered vessel to be charged with a fill. Once the discharge vessel has been charged with the gaseous fill, the port can be plugged, e.g., with a ceramic plug.

The end plugs include tubular portions 106, which provide the leg members of the finished discharge vessel and a widened disc shaped portion 110 which serves as the end wall of the body of the discharge vessel. An annular skirt 114, extending from the disc shaped portion 110, is received within the barrel portion 100 to form a seal therebetween. The electrode assembly is inserted into the end plug as shown. At the insertion stage, the internal diameter of the bore is $d_2$, which is greater than $d_1$, for example, at least 5% greater, and in one embodiment, at least 10% greater. The diameters of the conductor, bore, and surrounding end plug are selected to avoid building up so much stress, during sintering, that the ceramic cracks, but sufficient stress to allow the contraction of the end plug to yield a solid bond.

The end plugs 102, 104 may be shaped by injection molding of a mixture of ceramic materials and a binder, such as wax. In the process of injection molding, the mixture of ceramic material and binder is heated to form a highly viscous mixture. The mixture is then injected into a suitably shaped mold and then subsequently cooled to form a molded part. To ease removal, the outer surfaces of the tube portions may taper inward, towards their distal ends, as disclosed in U.S. Pat. No. 7,382,097.

The electrode assembly 64, 70, 80, 90 may be inserted into the end plug 102 during molding, e.g., using an insert molding process which allows a gap between the conductor and the end plug. In another embodiment, the electrode assembly 64, 70, 80, 90 is inserted into the injection molded part after it has been removed from the mold, e.g., prior to removal of the binder. Where the removal of the binder is carried out in an oxygen-containing environment, the oxidation-resistant barrier 72, 94 on the conductor core 60 serves to prevent oxidation of the underlying niobium metal. In another embodiment, the electrode assembly is inserted after binder removal, for example, before or after a bisque firing step, but before complete sintering at high temperature.

Subsequent to injection molding, the binder is removed from the molded part, typically by thermal treatment, to form a debindered part. The thermal treatment may be conducted by heating the molded part in air or a controlled environment, e.g., a vacuum, nitrogen, rare gas, to a maximum temperature, and then holding the maximum temperature. For example, the temperature may be solely increased by about 2-3° C. per hour from room temperature to a temperature of 160° C.

The debindered end plug, with the electrode assembly seated with the conductor in the bore as shown in FIG. 8, is then sintered to shrink the part and decrease its porosity. Prior to the final sintering step, the part may first be fired at an intermediate temperature in an oven in inert atmosphere by gradually raising the temperature over a period of hours to a maximum temperature of at least about 900° C., and in one embodiment, up to about 1100° C. The temperature is maintained for a sufficient time to achieve a partial shrinkage/porosity reduction. At this stage, the porosity of the bisque fired part may still be about 40-50%. The three components of the discharge vessel are then fitted together. Finally, the discharge vessel is sintered by slowly raising the temperature to a high temperature, e.g., about 1800° C. to 1900° C., in a hydrogen atmosphere having a dew point of about 10-15° C. After sufficient time to achieve the desired final porosity (e.g., about 3-5 hrs), the discharge vessel, together with the two attached electrode assemblies is cooled by gradually reducing the temperature. The resulting ceramic material comprises densely sintered polycrystalline alumina which is tightly bonded to the conductor within the bore.

The fill can be introduced through the fill port 105 and the port sealed. e.g., with a ceramic plug and a suitable sealing frit.

The ceramic powder for forming the discharge tube components may comprise alumina ($Al_2O_3$) having a purity of at least 99.98% and a surface area of about 1.5 to about 10 $m^2/g$, typically between 3-5 $m^2/g$. The alumina powder may be doped with magnesia to inhibit grain growth, for example in an amount equal to 0.03%-0.2%, in one embodiment, 0.05%, by weight of the alumina. Other ceramic materials which may be used include non-reactive refractory oxides and oxynitrides such as yttrium oxide, lutetium oxide, and hafnium oxide and their solid solutions and compounds with alumina such as yttrium-aluminum-garnet and aluminum oxynitride. The binder may comprise a wax mixture or a polymer mixture, such as one or more of polyols, polyvinyl alcohol, vinyl acetates, acrylates, cellulosics and polyesters.

According to an exemplary method of bonding, the densities of the bisque-fired parts used to form the cylindrical portion body member and the plug members are selected to achieve different degrees of shrinkage during the sintering step. The different densities of the bisque-fired parts may be achieved by using ceramic powders having different surface areas. For example, the surface area of the ceramic powder used to form the body member may be 6-10 $m^2/g$, while the surface area of the ceramic powder used to form the end plug members may be 2-3 $m^2/g$. The finer powder in the body member causes the bisque-fired cylindrical portion body member to have a lower density than the bisque-fired end plug members made from the coarser powder. The bisque-fired density of the cylindrical portion body member is typically 42-44% of the theoretical density of alumina (3.986 $g/cm^3$), and the bisque-fired density of the end plug members is typically 50-60% of the theoretical density of alumina. Because the bisque-fired body member is less dense than the bisque-fired plug members, the body member shrinks to a greater degree (e.g., 3-10%) during sintering than the plug member to form a seal around the skirt. By assembling the three components and electrode assembles prior to sintering, the sintering step bonds the three discharge tube components and electrode assembles together to form a discharge chamber.

According to another method of bonding, a glass frit, e.g., comprising a refractory glass, can be placed between the body member and the plug member, which bonds the two components together upon heating. According to this method, the parts can be sintered independently prior to assembly.

The body member and plug members typically each have a porosity of less than or equal to about 0.1%, e.g., less than 0.01%, after sintering. Porosity is conventionally defined as the proportion of the total volume of an article which is occupied by voids. The porosity of the bond region at the interface between the conductor and the leg member can also be less than or equal to about 0.1%, e.g., less than 0.01%, after sintering. At a porosity of 0.1% or less, the alumina typically has a suitable optical transmittance or translucency. The transmittance or translucency can be defined as "total transmittance," which is the transmitted luminous flux of a miniature incandescent lamp inside the discharge chamber divided by the transmitted luminous flux from the bare miniature incandescent lamp. At a porosity of 0.1% or less, the total transmittance is typically 95% or greater.

Without intending to limit the exemplary embodiment, the following Examples demonstrate the performance of the exemplary lamp.

EXAMPLES

Example 1

Figure 9:
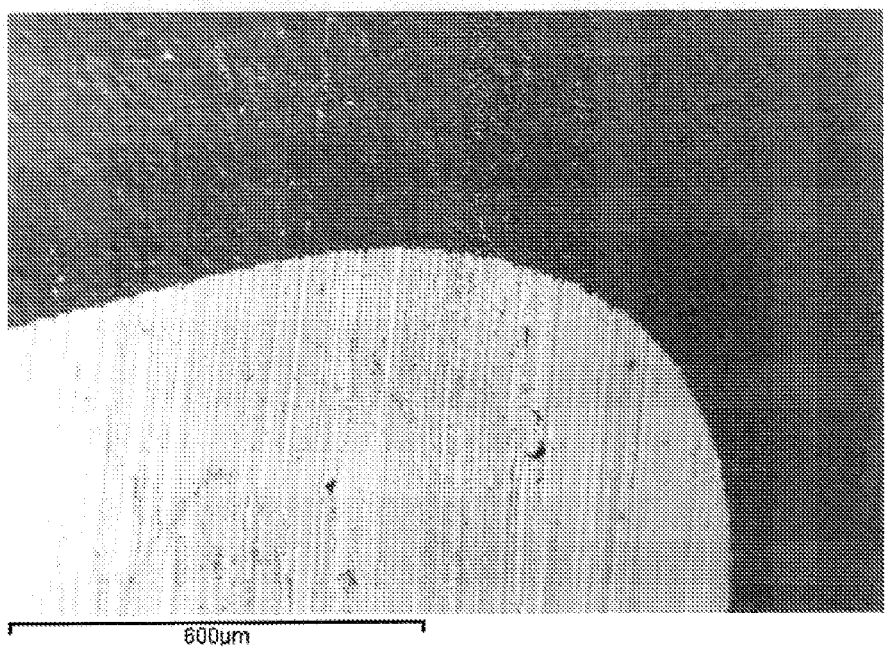
FIG. 9 is a micrograph showing a cross section through the seal generated between the conductor of the type shown in FIG. 4, and the end plug after sintering.
Figure 10:
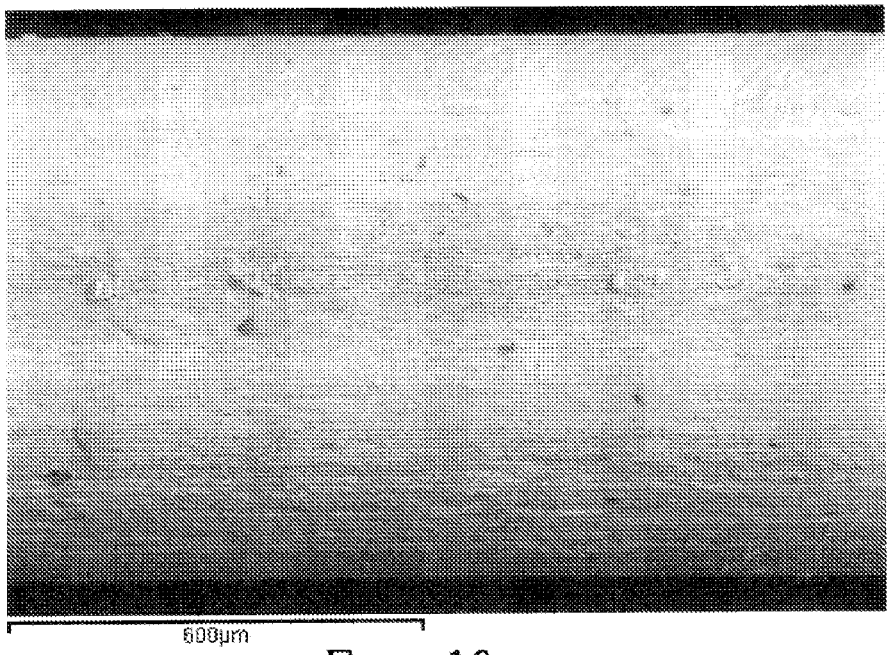
FIG. 10 is a micrograph showing the exterior surface of a niobium core prior to annealing.
Figure 11:
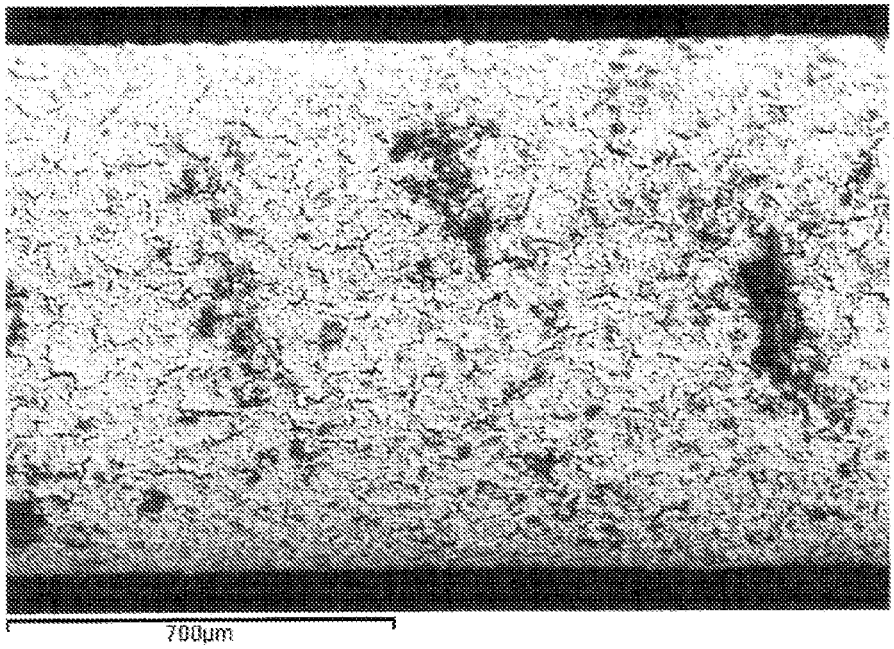
FIG. 11 is a micrograph showing the exterior surface of a niobium core after annealing at 1600° C. for 3 hours at approximately the same magnification as FIG. 10.
Figure 12:
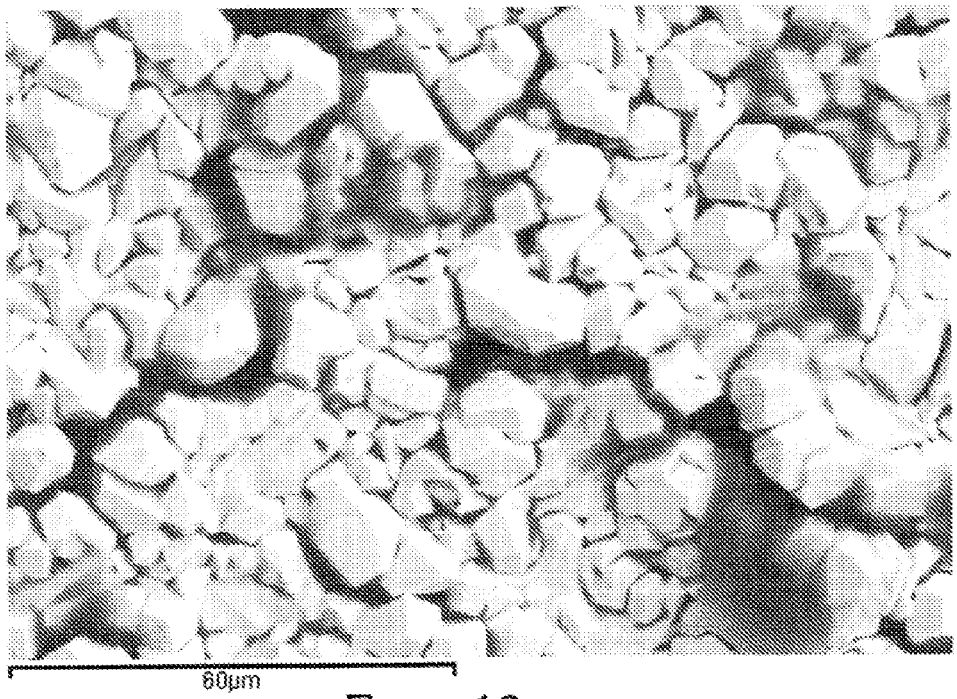
FIG. 12 shows the core of FIG. 11, at higher magnification, showing the granularity of the surface.
Figure 13:
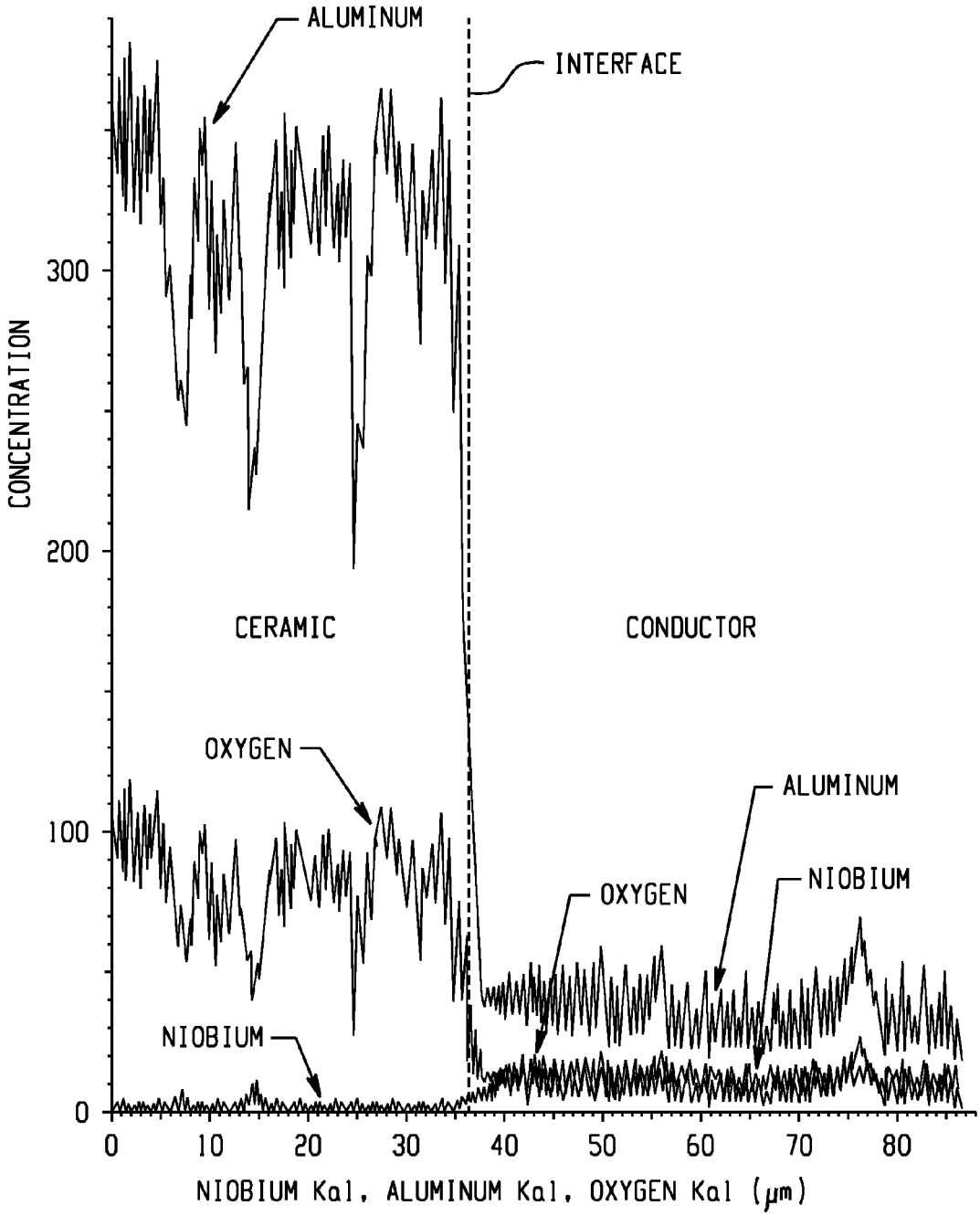
FIG. 13 is an EDX scan across the bond of FIG. 9, showing a sharp interface between the niobium core and alumina ceramic.

An electrode bonding portion comprising a niobium core was formed. The electrode assembly was annealed by heating the electrode assembly for 6 hrs at 1500° C. The conductor was placed in the bore of a debidered and fired end plug and sintered at 1800° C. After sintering, the cross sections of the conductor and surrounding leg members were obtained. Electron micrographs of cross sections of the bond showed a tight bond between the conductor and the polycrystalline alumina (FIG. 9). FIG. 10 shows the exterior of the core prior to annealing FIGS. 11 and 12 show the core after annealing at low and high magnification. EDX analysis in the bond region (FIG. 13) showed a sharp transition from aluminum oxygen (i.e., alumina) to niobium rich material at the interface.

Shock tests were performed on the bonded conductor/end plug by rapid cooling the assembly from 750° C. to 25° C. by dropping the assembly in water. Although the ceramic cracked, the bond remained intact.

Slow cooling cycles were also performed in which the assembly was allowed to cool from 750 C.° in air at ambient conditions until it was cool enough to handle, and then heated again in an oven to 750° C. After 20 of these cycles, the bond was still intact.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp comprising:

a ceramic discharge vessel comprising a body portion defining a discharge space and leg members extending therefrom;

electrode assemblies comprising:

conductors carried by bores of the leg members, at least one of the conductors being bonded directly to the respective leg member within the bore by sintering a ceramic body, without interposing a glass sealing material intermediate the conductor and the bore of the ceramic body, to shrink the ceramic body onto the conductor forming a heimetic seal therebetween to form an airtight seal, the at least one conductor comprising:

a core formed from an electrically conductive metal, the core including at least one of the group consisting of Nb, Ta, Re, and Os, and at least one of an oxidation-resistant layer and a corrosion-resistant layer on the core, the core having been heated to increase a grain size of its surface prior to covering the core with the at least one of the oxidation-resistant layer and the corrosion-resistant layer, and electrodes electrically connected to the conductors and extending into the discharge vessel; and an ionizable fill sealed within the vessel, wherein in the heating of the core to increase the grain size, the core is heated at a temperature of at least 1400° C.

2. The lamp of claim 1, wherein the core is predominantly formed from niobium.

3. The lamp of claim 1, wherein the ceramic is predominantly alumina and the core has a linear coefficient of thermal expansion $\alpha$ at 25° C. of from $5.0\text{-}7.4\times10^{-6}$/K at 25° C. and a thermal conductivity $\lambda$ of from 0.4-1.1 W/cm/K at 27° C.

4. The lamp of claim 1, wherein the core includes an oxide layer comprising niobium oxide.

5. The lamp of claim 1, wherein the at least one conductor comprises the oxidation-resistant layer on the core, the oxidation-resistant layer being formed from an oxide of one of the group consisting of Hf, Ni, Ta, Yb, Y, and combinations thereof.

6. The lamp of claim 5, wherein the at least one conductor comprises the corrosion resistant layer on the core, the corrosion resistant layer spacing the core from the oxidation-resistant layer.

7. The lamp of claim 1, wherein:

the corrosion resistant layer is on the core, and the ionizable fill comprises a rare earth element which is corrosive towards the core.

8. The lamp of claim 7, wherein the corrosion-resistant layer is formed from one of the group consisting of Mo, Ta, Zr, Lu, Re, Os, W, WC, TaC, YC, Zr, and combinations thereof.

9. The lamp of claim 7, wherein the corrosion-resistant layer is formed predominantly of molybdenum.

10. The lamp of claim 7, wherein the corrosion-resistant layer has a thickness of at least 1 μm.

11. The lamp of claim 7, wherein the corrosion-resistant layer spaces the core from an oxidation-resistant layer.

12. The lamp of claim 1, wherein the at least one of the conductors is formed by covering at least a portion of the core with both the oxidation resistant layer and the corrosion resistant layer, the corrosion resistant layer spacing the oxidation resistant layer from the core.

13. A lamp as recited in claim 1 formed by a method comprising:

forming one of the electrode assemblies from a respective one of the electrodes and a respective one of the conductors;

inserting the respective conductor into the bore of a ceramic body which is to be a respective leg member;

sintering the ceramic body to shrink the ceramic body and bond the conductor to the ceramic body around the bore without interposing any glass sealing material therebetween; and, incorporating the electrode assembly with the respective bonded conductor and sintered ceramic body into a lamp such that the electrode protrudes from the sintered ceramic body into the interior discharge space.

14. The lamp of claim 13, wherein the incorporating comprises bonding the ceramic body, which is to be a respective leg member, to at least one other ceramic body to form the air-tight discharge vessel wherein the electrode extends into the interior discharge space defined by the discharge vessel.

15. The lamp of claim 14, wherein the forming of the one of the electrode assemblies includes covering the core with at least one of an oxidation resistant layer and a corrosion resistant layer.

16. The lamp of claim 15, further comprising heating the core to increase a grain size of its surface prior to covering the core with at least one of the oxidation-resistant layer and the corrosion-resistant layer.

17. The lamp of claim 15, wherein the forming of the one of the electrode assemblies includes covering at least a portion of the core with both the oxidation resistant layer and the corrosion resistant layer, the corrosion resistant layer spacing the oxidation resistant layer from the core.

18. The lamp of claim 15, wherein the core is electrically conductive and the core is provided with both the oxidation-resistant layer and the corrosion-resistant layer, the corrosion resistant layer spacing the oxidation resistant layer from the core.

19. A lamp comprising:

a ceramic discharge vessel comprising a body portion defining a discharge space and polycrystalline alumina leg members extending therefrom;

electrode assemblies comprising:

conductors carried by bores of the leg members, at least one of the conductors being bonded directly to the respective leg member within the bore by sintering to form a hermetic seal therebetween to form an airtight seal, the at least one conductor including a core formed from an electrically conductive metal selected from Nb, Ta, Re, Os, and combinations thereof and an oxidation-resistant layer on the core formed from an oxide of one of the group consisting of Hf, Ni, Ta, Yb, Y, and combinations thereof, the core having been heated to increase a grain size of its surface prior to covering the core with the oxidation-resistant layer, the heating raising the grain size to slightly less than or comparable to that of the ceramic of the leg member into which it is to be inserted; and electrodes electrically connected to the conductors and extending into the discharge vessel; and an ionizable fill sealed within the vessel.

20. The lamp of claim 19, wherein the oxidation-resistant layer has a melting point in excess of 1200° C.

21. The lamp of claim 19, wherein the oxidation-resistant layer has a thickness of at least 1 μm.

22. The lamp of claim 19, wherein in the heating of the core to increase the grain size the core is heated at a temperature of at least 1400° C.

23. A lamp comprising:

a ceramic discharge vessel comprising a body portion defining a discharge space and leg members extending therefrom;

electrode assemblies comprising:

conductors carried by bores of the leg members, at least one of the conductors being bonded directly to the respective leg member within the bore by sintering a ceramic body, without interposing a glass sealing material intermediate the conductor and the bore of the ceramic body, to shrink the ceramic body onto the conductor forming a hermetic seal therebetween to form an airtight seal, the at least one conductor comprising:

a core formed from an electrically conductive metal, the core including at least one of the group consisting of Nb, Ta, Re, and Os, and at least one of an oxidation-resistant layer and a corrosion-resistant layer on the core, the core having been heated to increase a grain size of its surface prior to covering the core with the at least one of the oxidation-resistant layer and the corrosion-resistant layer, and electrodes electrically connected to the conductors and extending into the discharge vessel; and an ionizable fill sealed within the vessel, wherein in the heating of the core to increase the grain size, a grain size of the core is increased to slightly less than or comparable to that of the ceramic of the leg member into which it is to be inserted.

* * * * *